US006159027A

United States Patent [19]

Kuo

[11] Patent Number: 6,159,027

[45] Date of Patent: Dec. 12, 2000

[54] CARD CONNECTOR WITH EXPANDABLE MODULAR CARD EJECTION DEVICE

[75] Inventor: Ming-Lun Kuo, Taipei, Taiwan

[73] Assignee: Hon Hai Precision Ind. Co., Ltd., Taipei Hsien, Taiwan

[21] Appl. No.: 09/333,194

[22] Filed: Jun. 14, 1999

[30] Foreign Application Priority Data

Dec. 31, 1998 [TW] Taiwan ..... 87222128

[51] Int. Cl.[7] ..... H01R 13/62

[52] U.S. Cl. ..... 439/159

[58] Field of Search ..... 439/160, 159, 439/64, 152–157

[56] References Cited

U.S. PATENT DOCUMENTS 5,389,001 2/1995 Broschard, III et al. ..... 439/159

6,033,243 3/2000 Kajiura ..... 439/159

*Primary Examiner*—Brian Sircus
*Assistant Examiner*—Son V. Nguyen
*Attorney, Agent, or Firm*—Wei Te Chung

[57] ABSTRACT

A card connector comprises a U-shaped insulative housing including an elongate base and a pair of arms, a number of contacts received in the housing and an elongate modular card ejection device. The modular card ejection device comprises a main body and an engaging portion having a T-shaped cross section provided on a side of the main body. Each arm forms a receiving space having a T-shaped cross section in a side face thereof. The receiving space further defines a recess in a middle position thereof. The engaging portion forms an elongate projection outwardly extending from an end thereof. The engaging portion engages with the receiving space and the projection is received in the recess thereby retaining the modular card ejection device on one arm of the housing.

4 Claims, 3 Drawing Sheets

CARD CONNECTOR WITH EXPANDABLE MODULAR CARD EJECTION DEVICE

BACKGROUND OF THE INVENTION

The present invention relates to a connector, and particularly to a card connector having a modular expandable card ejection device assembled to either side thereof.

As electronic technology advances, electrical devices are becoming increasingly smaller, while the functional performance of the devices greatly improves. U.S. Pat. Nos. 5,827,075; 5,846,096 and Taiwan Patent Application Nos. 84210015, 84217977, 86204066 disclose several such connectors. A conventional card connector comprises an insulative housing, a plurality of conductive contacts received in the housing and a non-expandable ejection device assembled to one side of the housing. However, since a push bar of the ejection device is slender and does not have any protection, the push bar can be easily damaged. Furthermore, the card ejection device is not convenient to use due to its non-expandable nature. To overcome the disadvantages, an expandable ejection device is proposed to be attached to a side of the conventional card connector. This ejection device has a hollow main body which can protect the slender push bar slidably received therein. However, due to the structural limitation, the conventional expandable ejection device can only be attached to a specified side of two of the connector. Hence, an improved electrical card connector is required to overcome the disadvantages of the prior art.

BRIEF SUMMARY OF THE INVENTION

An object of the present invention is to provide a card connector having a modular expandable card ejection device which can be assembled to either side of the connector.

Accordingly, an electrical connector comprises a U-shaped insulative housing including an elongate base and a pair of arms, a plurality of contacts received in the housing and an elongate modular expandable card ejection device. The card ejection device comprises a main body and an engaging portion having a T-shaped cross section provided on a side of the main body. Each arm forms a receiving space having a T-shaped cross section in a side face thereof. The receiving space further defines a recess in a middle position thereof. The engaging portion forms an elongate projection outwardly extending from an end thereof The engaging portion engages with the receiving space and the projection is received in the recess thereby retaining the modular ejection card device on one arm of the housing.

Other objects, advantages and novel features of the invention will become more apparent from the following detailed description of the present embodiment when taken in conjunction with the accompanying drawings.

DETAILED DESCRIPTION OF THE INVENTION

Figure 1:
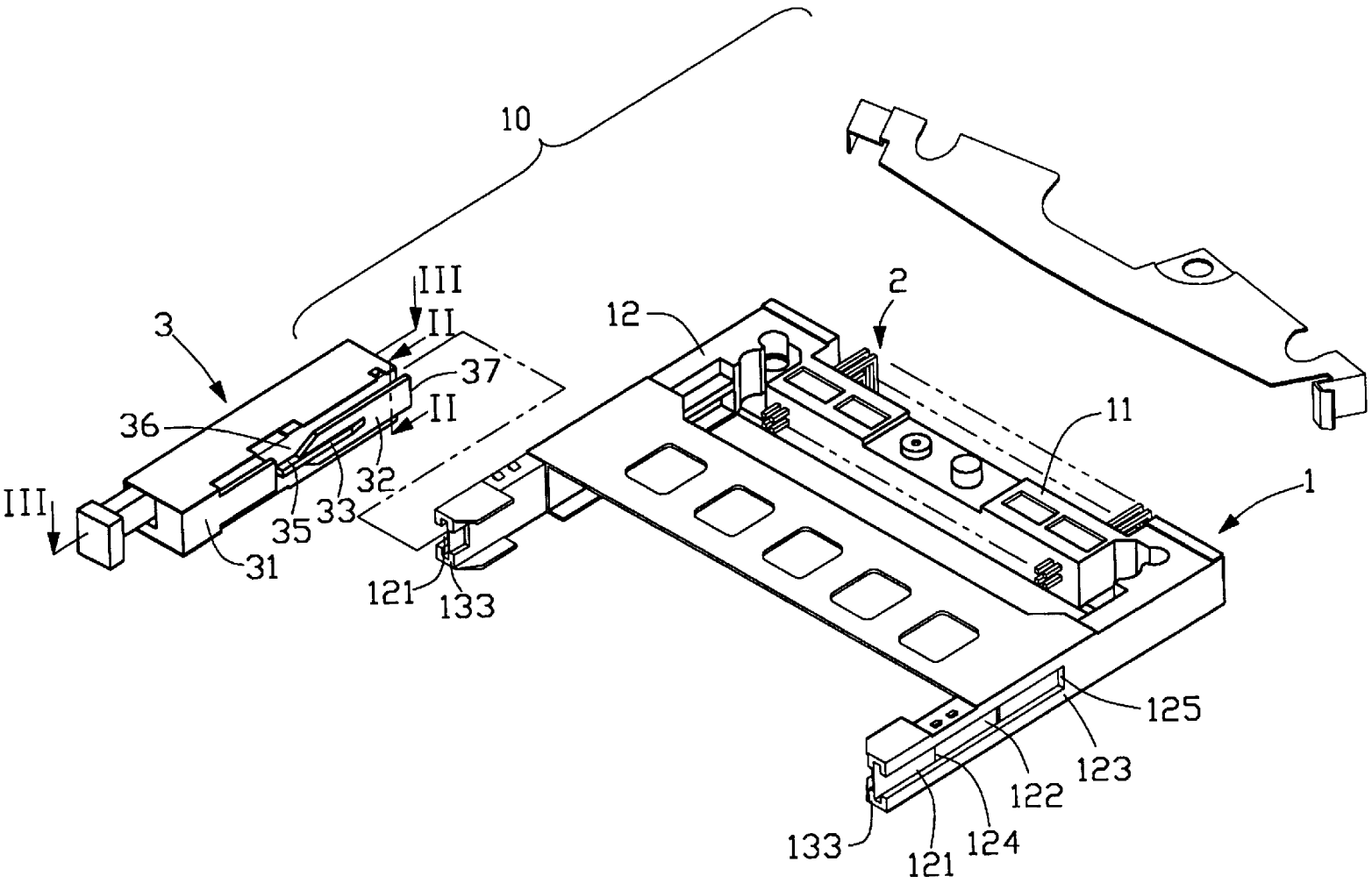
FIG. 1 is a partially exploded view of a card connector of the present invention.
Figure 2:
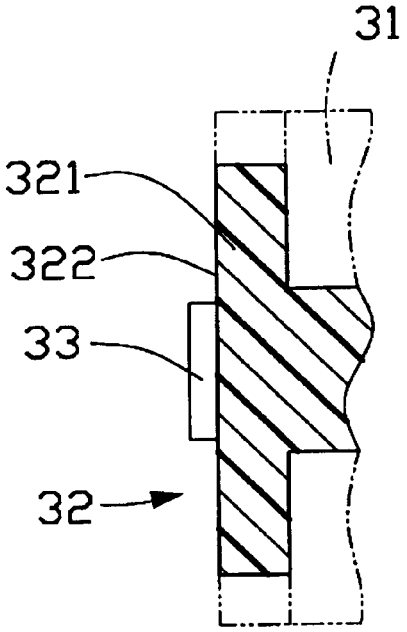
FIG. 2 is a cross-sectional view of an expandable modular card ejection device of the card connector II—II of FIG. 1.

Referring to FIGS. 1 and 2, a card connector 10 in accordance with the present invention which as shown is a compact flash (CF) connector comprises an insulative housing 1 having an elongate base 11 and a pair of arms 12 extending from opposite ends of the base 11, a plurality of contacts 2 received in the base 11 and a modular card ejection device 3. Each arm 12 forms a receiving space 121 in an outer side face 123 thereof. The receiving space 121 has a T-shaped cross section and further defines a recess 122 depressed in a bottom of a middle portion of the receiving space 121.

The modular card ejection device 3 comprises a main body 31 and an engaging portion 32 having a T-shaped cross section 321 provided on a side wall 36 of the main body 31. The T-shaped cross section 321 has an outer surface 322 forms an elongate projection 33 laterally extending from the outer surface 322 of the T-shaped cross section 321 at a position corresponding to the recess 122 of the arm 12. A gap 34 (FIG. 3) is defined between a free end 35 of the projection 33 and the side wall 36 of the main body 31 whereby the free end 35 of the projection 33 is resilient and recoverably flexes during the assembly, allowing the modular card ejection device 3 to connect to one of the arms 12 of the housing 1.

Figure 3:
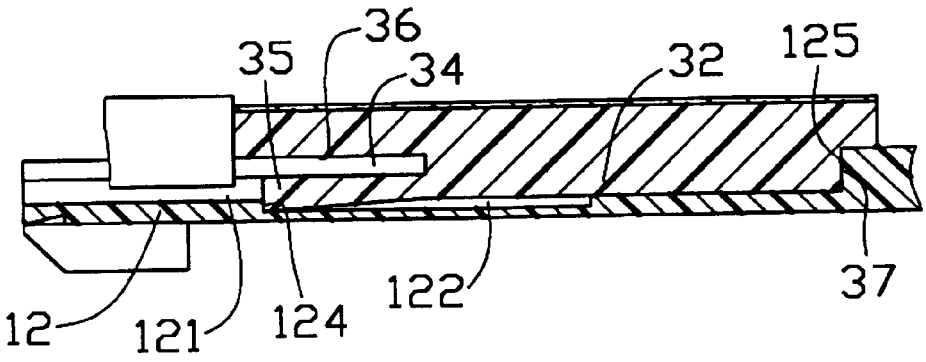
FIG. 3 is a cross-sectional view of the card connector taken along line III—III of FIG. 1 after the expandable modular card ejection device is assembled to an arm of a housing of the card connector.
Figure 4:
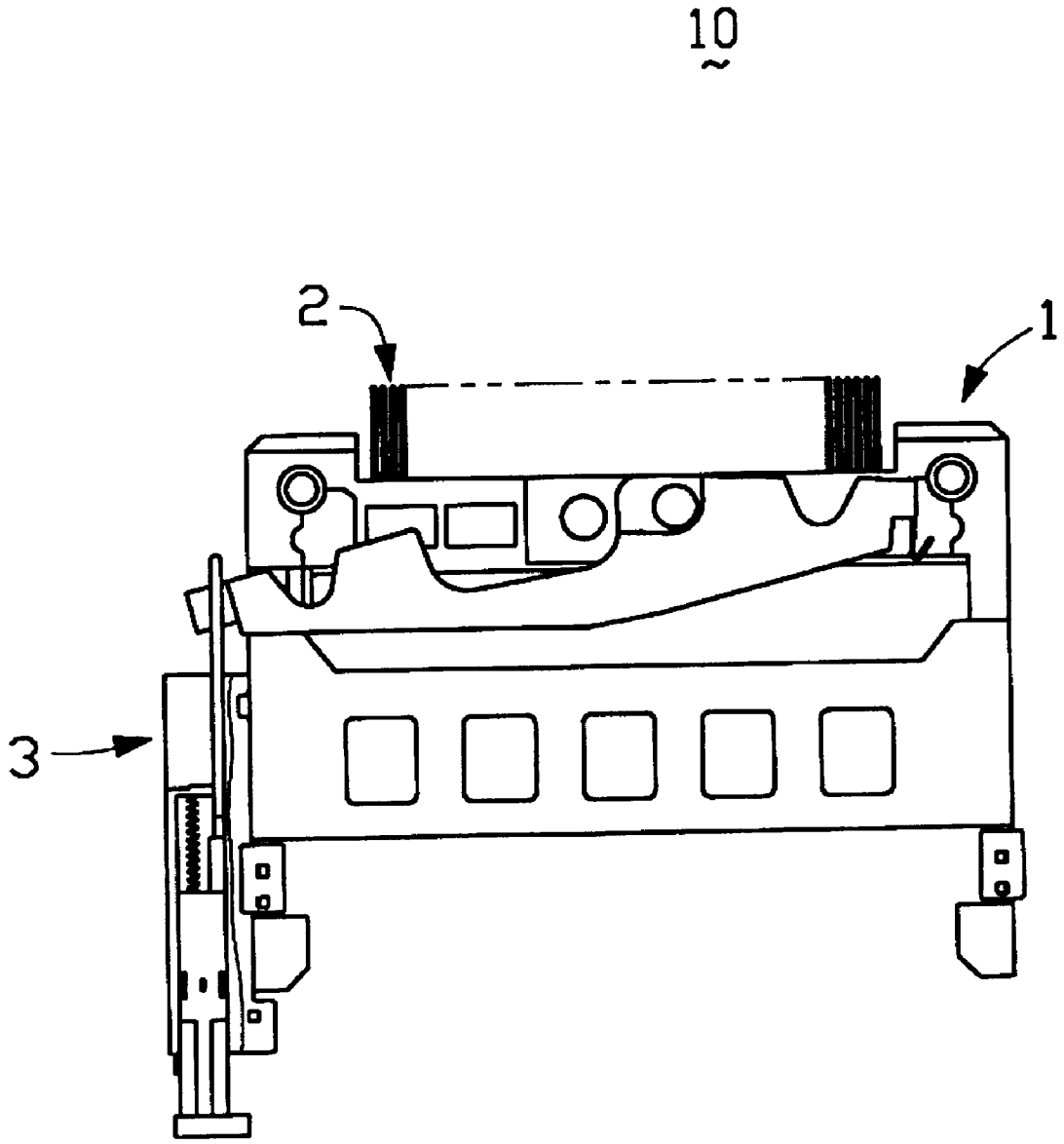
FIG. 4 is a top view of the card connector in accordance with a first embodiment of the present invention.

Also referring to FIGS. 3 and 4, the engaging portion 32 is slidably received in the receiving space 121 from a free end 133 of the arm 12 thereby engaging together. The free end 35 of the projection 33 is urged to be received in the recess 122 of the housing 1 due to the resiliency of the free end 35 and abuts against a periphery 124 of the recess 122 thereby preventing a rear movement of the modular card ejection device 3 from the arm 12. An opposite end 37 of the engaging portion 32 abuts against a periphery 125 of the receiving space 121 which is distanced from the free end 133 of the arm 12 to prevent a forward movement of the modular card ejection device 3 on the arm 12. Thus, the modular card ejection device 3 is securely retained on a side of the housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having an elongate base and a pair of arms integrally extending from opposite ends of the base, each of the arms forming a receiving space in an outer side face thereof, the receiving space having a T-shaped cross section and a recess depressed in a bottom of a middle portion of the receiving space;

a plurality of contacts received in the base of the housing; and a modular card ejection device comprising a main body having a side wall and an engaging portion provided on the side wall of the main body, the engaging portion having a T-shaped cross section and having an outer surface and an elongate projection laterally protruding beyond the outer surface of the engaging portion, the engaging portion fitting within the receiving space of a selected one of the arms of the housing and the projection being received in the recess in the receiving space of the selected one of the arms of the housing thereby selectively retaining the modular card ejection device on the selected one of the arms of the housing; wherein the housing itself is symmetric in a left-to-right direction, and the modular card ejection device is optionally selectively mounted to the outer side face of one of said arms.

2. The electrical connector as claimed in claim 1, wherein the projection has a free end spaced from the side wall of the main body of the modular card ejection device and a gap is defined between the free end of the projection and the side wall of the main body of the modular card ejection device whereby the free end of the projection is resilient and recoverably flexes while being received in the recess of the selected one of the arms of the housing.

3. The electrical connector as claimed in claim 1, wherein the engaging portion of the modular card ejection device is slidably retained in the receiving space of the housing.

4. An electrical connector comprising:

an insulative housing having an elongate base and a pair of arms extending from opposite ends of the base, each of the arms forming a receiving space in an outer side face thereof, the receiving space having a recess depressed in a bottom of a middle portion of the receiving space;

a plurality of contacts received in the base of the housing; and a modular card ejection device comprising a main body having a side wall and an engaging portion provided on the side wall of the main body, the engaging portion forming an elongate projection laterally protruding therefrom and apart from the side wall of the main body, the elongate projection having a flexible end whereby the engaging portion is retainably received within the receiving space of a selected one of the arms of the housing and the elongate projection is retainably received within the corresponding recess so that the ejection device is retained to the selected one of the arms of the housing; wherein the housing itself is symmetric in a left-to-right direction, and the modular card ejection device is optionally selectively mounted to the outer side face of one of said arms.

* * * * *